United States Patent [19]

Baumgaertner et al.

[11] Patent Number: 4,490,451

[45] Date of Patent: Dec. 25, 1984

[54] MULTILAYER ELECTROPHOTOGRAPHIC RECORDING MATERIAL COMPRISES A SELENIUM-TELLURIUM FIRST LAYER AND SELENIUM-ARSENIC CONTAINING SECOND LAYER

[75] Inventors: Armin Baumgaertner, Ludwigsburg; Kurt Elsaesser, Nuremberg, both of Fed. Rep. of Germany

[73] Assignee: International Standard Electric Corporation, New York, N.Y.

[21] Appl. No.: 501,933

[22] Filed: Jun. 7, 1983

[30] Foreign Application Priority Data

Jun. 24, 1982 [DE] Fed. Rep. of Germany ..... 3223571

[51] Int. Cl.[3] ..... G03G 5/082

[52] U.S. Cl. ..... 430/57; 430/60; 430/63; 430/86

[58] Field of Search ..... 430/57, 86, 60, 63

[56] References Cited

U.S. PATENT DOCUMENTS 4,296,191 10/1981 Jacobson et al. ..... 430/57

*Primary Examiner*—John D. Welsh

*Attorney, Agent, or Firm*—James B. Raden

[57] ABSTRACT

The recording material comprises a metallic base, for example, of aluminum, a twenty to sixty μm thick layer of selenium with a content of tellurium ranging between 5 and 30 percent by wt. and a layer of selenium having a thickness ranging between 0.5 and 3 μm arranged thereon containing 0.5 to 5 percent by wt. of arsenic. Instead of the layer of selenium containing arsenic, there may also be provided a layer of arsenic-triselenside. Preferably, the content of tellurium in the selenium layer containing tellurium, increases either step-by-step or continuously from the metallic base up to the layer of selenium containing arsenic. The electrophotographic recording material has a sensitivity within the region from 600 to 850 nanometers, the surface is stabilized against corona effects, and the material has a good residual potential behavior.

16 Claims, 2 Drawing Figures

MULTILAYER ELECTROPHOTOGRAPHIC RECORDING MATERIAL COMPRISES A SELENIUM-TELLURIUM FIRST LAYER AND SELENIUM-ARSENIC CONTAINING SECOND LAYER

BACKGROUND OF THE INVENTION

The present invention relates to an electrophotographic recording material comprising a metallic base, a layer of selenium containing tellurium arranged thereon, and a further layer of selenium arranged on the first layer.

From German Patent DE-AS No. 1,932,105 there is already known an electrophotographic recording material in which, on a metallic base, there is arranged a layer of selenium and on this a layer of selenium-tellurium. From this prior art there is further known an electrophotographic recording material in which on a metallic base there is arranged a layer of selenium-tellurium on which, in turn, there is arranged a layer of selenium, and with an insulating layer being arranged on this layer of selenium. In this case there may exist a continuous transition from the layer of selenium-tellurium to the layer of selenium.

Moreover, from German Patent DE-AS No. 2,305,407 there is known an electrophotographic recording material in which on a metallic base there is arranged a layer of selenium having a thickness ranging between 5 and 50 μm (micrometer), on which layer there is arranged a layer of selenium with an addition of lead, with this layer of selenium containing lead being topped by a layer of selenium containing arsenide, having a thickness ranging between 1 and 50 μm.

Further, from the report of the 1981 Meeting on Electrophotography in Venice, on page 125 there is described a sequence of layers in which on a base there is arranged an amorphous layer of selenium having a thickness of 60 μm, on which, in turn, there is arranged a layer of selenium-tellurium having a thickness of 0.3 μm, with this layer of selenium-tellurium being topped by a very thin protective layer of arsenic-selenium.

Finally, from German Patent DE-AS No. 1,277,016 it is known to arrange on an insulating base a layer of selenium-tellurium having a thickness of 0.1 μm, and on this a layer of an insulating photoconductor, such as a layer of selenium having a thickness of 50 μm. Relative thereto, the thickness of the thin layer of selenium-tellurium may not exceed 0.2 μm.

As can be seen from the aforementioned prior art, the electrophotographic properties of a layer structure including a metallic base, a layer of selenium-tellurium having a thickness of 25 μm, a layer of selenium having a thickness of 1 μm, and a protective layer of polycarbonate, is not satisfactory. Owing to the protective layer provided for in the conventional arrangement, comprising a pure insulator, the electrophotographic properties of the recording material are deteriorated.

An improvement can of course be achieved by using as the protective layer a layer of selenium-arsenic, as is described in the report of the 1981 meeting in Venice. Such a photosensitive protective layer provided a substantial improvement of the charge fatigue. Such a layer structure, however, has a poor residual potential behaviour.

SUMMARY OF THE INVENTION

An object of the present invention is to provide an electrophotographic recording material, which has a sensitivity within the 600 to 850 nanometer range, whose surface is stabilized against corona effects, and which has a good residual potential behaviour.

A feature of the present invention is the provision of an electrophotographic recording material comprising: a metallic base; a first layer disposed on the base having a thickness ranging between 20 to 60 micrometers, the first layer including selenium containing 5 to 30 percent by weight of tellurium; and a second layer disposed on the first layer having a thickness ranging between 0.5 to 3 micrometers, the second layer including a selected one of selenium containing 0.5 to 5 percent by weight of arsenic and arsenic triselenide.

This layer structure can still be further improved by varying the content of tellurium in the layer of selenium adjoining the base. This can be accomplished by having this layer made up of several partial layers having a content of tellurium increasing from the metallic base upwardly. However, there may also be provided for an equal increase of the content of tellurium throughout the thickness of this layer, e.g., by simultaneously vapor depositing both the selenium and the tellurium. Preferably, there is chosen a layer structure in which, in the layer adjoining the base, the content of tellurium increases from 5 percent by wt. up to 30 percent by wt. This substantially reduces the light fatigue of the electrophotographic recording material.

The metallic base can be made from any suitable metal. Preferably, however, there is used a plate or drum of aluminum.

The individual layers are deposited by way of evaporating the corresponding substances in vacuum. Preferably, however, the individual substances are vaporized from separate vaporizers, with the proportion of the individual substances in the layer being determined by controlling the temperature of the individual vaporizers. By changing the vaporizing temperature while manufacturing a layer, it is possible to vary the composition via the layer thickness.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
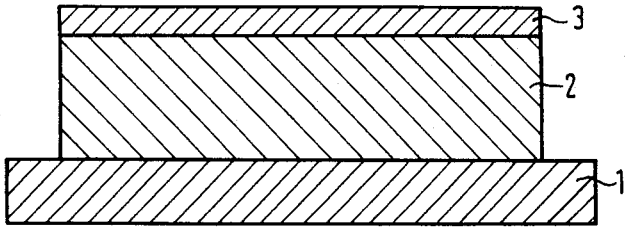
FIG. 1 is a cross-sectional view of a first embodiment of the electrophotographic recording material in accordance with the principles of the present invention.

In the arrangement as shown in FIG. 1, the recording material comprises a metallic base 1, preferably aluminum, on which a layer of selenium 2, containing tellurium, is arranged. This layer of selenium, for example, has a thickness of 60 μm and contains 15 percent by wt. of tellurium. On this layer of selenium 2 containing tellurium, there is arranged a further layer 3 including selenium containing arsenic. This layer has a thickness ranging between 0.5 and 3 μm and contains 0.5 to 5 percent by wt. of arsenic.

In a modification of the embodiment as shown in FIG. 1, the layer 3 comprise arsenic triselenide ($As_2Se_3$), with the thickness of the layer likewise ranging between 0.5 and 3 μm.

Figure 2:
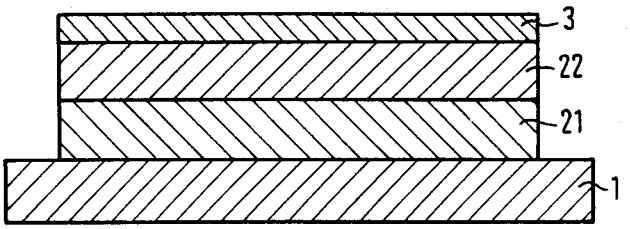
FIG. 2 is a cross-sectional view of a second embodiment of the electrophotographic recording material in accordance with the principle of the present invention.

In the embodiment as shown in FIG. 2, a first layer of selenium 21 containing tellurium is arranged on a metallic base 1 of aluminum, and on this there is arranged a second layer of selenium 22 containing tellurium, and this layer 22 is topped by a layer of selenium 3 containing arsenic. The tellurium content of the layer 21 and 22 ranges between 5 and 30 percent by wt., with the layer 21 adjoining the base 1 having a smaller tellurium content than the layer 22. The layer 21, for example, includes a layer of selenium having a thickness of 25 μm and a tellurium content of 5 percent by wt. (weight), whereas the layer 22 includes a 25 μm thick layer of selenium having a content of tellurium of 30 percent by wt. The layer 3, also in this particular case, may again comprise either a selenium layer having a content of 0.5 to 5 percent by wt. of arsenic, or a layer of arsenic triselenide. In both cases, the thickness of the layer 3 ranges between 0.5 and 5 μm. The layer 21 may additionally contain halogen.

Instead of the two layers 21 and 22 as shown in FIG. 2, there may also be provided several successively following layers, and the total thickness of all of these layers should not exceed 60 μm. The content of tellurium of the individual layers is chosen thus that it increases from the layer adjoining the base 1 up to the layer adjoining the layer 3 containing arsenic, and ranges preferably between 5 and 30 percent by wt. of tellurium.

Finally, in the type of embodiment as shown in FIG. 2, the arrangement can also be made in such a way that instead of the layers 21 and 22 there is provided one single layer of selenium containing tellurium, as in the example according to FIG. 1, with the content of tellurium thereof, however, gradually increasing from the side of base 1, so that the content of tellurium reaches its maximum within the region adjoining the layer 3. This can be achieved by controlling the temperature of the individual vaporizers during the vapor deposition of the layer substances.

It should also be pointed out that the layer thicknesses as shown in the drawing, have been chosen arbitrarily, so that a certain thickness ratio cannot be derived from the drawing.

While we have described above the principles of our invention in connection with specific apparatus, it is to be clearly understood that this description is made only by way of example and not as a limitation to the scope of our invention as set forth in the objects thereof and in the accompanying claims.

We claim:

1. An electrophotographic recording material comprising:

a metallic base;

a first layer disposed on said base having a thickness ranging between 20 to 60 micrometers, said first layer including selenium containing 5 to 30 percent by weight of tellurium;

a second layer disposed on said first layer having a thickness ranging between 0.5 to 3 micrometers, said second layer including a selected one of: (a) selenium containing 0.5 to 5 percent by weight of arsenic and (b) arsenic triselenide;

said tellurium content of said first layer adjacent said base being smaller than said tellurium content adjacent said second layer; and said first layer including at least two partial layers each having a successively higher tellurium content starting with that one of said two partial layers adjacent said base.

2. A material according to claim 1, wherein said tellurium content of said one of said two partial layers is approximately 5 percent by weight at least adjacent said base and said tellurium content of the other of said two partial layers is approximately 30 percent by weight at least adjacent said second layer.

3. An electrophotographic recording material comprising:

a metallic base;

a first layer disposed on said base having a thickness ranging between 20 to 60 micrometers, said first layer including selenium containing 5 to 30 percent by weight of tellurium;

a second layer disposed on said first layer having a thickness ranging between 0.5 to 3 micrometers, said second layer including a selected one of: (a) selenium containing 0.5 to 5 percent by weight of arsenic and (b) arsenic triselenide;

said tellurium content of said first layer adjacent said base being smaller than said tellurium content adjacent said second layer; and said tellurium content of said first layer increasing continuously as the thickness of said first layer increases starting from a portion of said first layer adjacent said base.

4. A material according to claim 3, wherein said tellurium content is approximately 5 percent by weight adjacent said base and approximately 30 percent by weight adjacent said second layer.

5. An electrophotographic recording material comprising:

a metallic base;

a first layer disposed on said base having a thickness ranging between 20 to 60 micrometers, said first layer including selenium containing 5 to 30 percent by weight of tellurium;

a second layer disposed on said first layer having a thickness ranging between 0.5 to 3 micrometers, said second layer including selenium containing 0.5 to 5 percent by weight of arsenic, and;

said tellurium content of said first layer adjacent said base being smaller than said tellurium content adjacent said second layer.

6. A material according to claim 5, wherein said tellurium content is approximately 5 percent by weight adjacent said base and approximately 30 percent by weight adjacent said second layer.

7. A material according to claim 5, wherein said first layer includes at least two partial layers each having a successively higher tellurium content starting with that one of said two partial layers adjacent said base.

8. A material according to claim 7, wherein said tellurium content of said one of said two partial layers is approximately 5 percent by weight at least adjacent said base and said tellurium content of the other of said two partial layers is approximately 30 percent by weight at least adjacent said second layer.

9. A material according to claim 5, wherein said tellurium content of said first layer increases continuously as the thickness of said first layer increases starting from a portion of said first layer adjacent said base.

10. A material according to claim 9, wherein said tellurium content is approximately 5 percent by weight adjacent said base and approximately 30 percent by weight adjacent said second layer.

11. An electrophotographic recording material comprising:

a metallic base;

a first layer disposed on said base having a thickness ranging between 20 to 60 micrometers, said first layer including selenium containing 5 to 30 percent by weight of tellurium;

a second layer disposed on said first layer having a thickness ranging between 0.5 to 3 micrometers, said second layer including arsenic triselenide; and, said tellurium content of said first layer adjacent said base being smaller than said tellurium content adjacent said second layer.

12. A material according to claim 11, wherein said tellurium content is approximately 5 percent by weight adjacent said base and approximately 30 percent by weight adjacent said second layer.

13. A material according to claim 11, wherein said first layer includes at least two partial layers each having a successively higher tellurium content starting with that one of said two partial layers adjacent said base.

14. A material according to claim 13, wherein said tellurium content of said one of said two partial layers is approximately 5 percent by weight at least adjacent said base and said tellurium content of the other of said two partial layers is approximately 30 percent by weight at least adjacent said second layer.

15. A material according to claim 11, wherein said tellurium content of said first layer increases continuously as the thickness of said first layer increases starting from a portion of said first layer adjacent said base.

16. A material according to claim 15, wherein said tellurium content is approximately 5 percent by weight adjacent said base and approximately 30 percent by weight adjacent said second layer.

* * * * *